US005763994A

United States Patent [19]

Kim

[11] Patent Number: 5,763,994

[45] Date of Patent: Jun. 9, 1998

[54] CATHODE RAY TUBE HAVING A CORRECTOR FOR A DEFLECTION YOKE

[75] Inventor: Hoo-deuk Kim, Pusan, Rep. of Korea

[73] Assignee: Samsung Display Devices Co., Ltd., Kyungki-do, Rep. of Korea

[21] Appl. No.: 733,082

[22] Filed: Oct. 16, 1996

[30] Foreign Application Priority Data

Oct. 30, 1995 [KR] Rep. of Korea ..... 1995-38227

[51] Int. Cl.[6] ..... H01J 29/70

[52] U.S. Cl. ..... 313/440; 313/431

[58] Field of Search ..... 313/440, 431, 313/433, 413; 335/213, 299

[56] References Cited

U.S. PATENT DOCUMENTS 5,177,399 1/1993 Fujiwara et al. ..... 313/440

5,182,487 1/1993 Ohtsu ..... 313/440

5,565,732 10/1996 Sluyterman et al. ..... 313/440

*Primary Examiner*—George M. Dombroske

*Assistant Examiner*—Harshad Patel

*Attorney, Agent, or Firm*—Leydig, Voit & Mayer, Ltd.

[57] ABSTRACT

A cathode ray tube includes an electron gun for emitting an electronic beam, a deflection yoke which deflects the emitted electronic beam, and a corrector including electromagnets installed in the up-and-down and right-and-left sides of a separator of the deflection yoke for correcting the shape of the section of the emitted electronic beam. Resolution of the picture can be improved by correcting the distortion of the section of the electronic beam which is landed at the edge of a fluorescent film.

4 Claims, 4 Drawing Sheets

CATHODE RAY TUBE HAVING A CORRECTOR FOR A DEFLECTION YOKE

BACKGROUND OF THE INVENTION

The present invention relates to a cathode ray tube, and, more particularly, to a cathode ray tube having a corrector for preventing the cross-section of an electron beam which is emitted from an electron gun, deflected by a deflection yoke, and lands on a fluorescent film, from being distorted.

Generally, a cathode ray tube forms pixels by directing the electron beam emitted from the electron gun sealingly coupled in the neck portion thereof to a fluorescent film on the inside of a pannel. The electron beam is selectively deflected by the deflection yoke and forms a picture from the collective pixels. The electron beam should and correctly on the fluorescent point of the fluorescent film to produced a fine picture. However, the spot of the electron beam which lands on the fluorescent film may be distorted since the deflection coil of the deflection yoke forms nonuniform deflection magnetic fields and the geometric curvature of the inside of the panel is distorted.

The deflection magnetic field of the deflection yoke which deflects the electron beam, as shown in FIG. 1, consists of a pin-cushion magnetic field 11 formed by a horizontal deflection coil and a barrel magnetic field 12 formed by a vertical deflection coil. As shown, the magnetic fields respectively applied to the red (R), green (G), and blue (B) electron beams emitted from an electron gun (not shown) are all nonuniform. Therefore, when the electron beam which receives a deflection force, passing through the nonuniform pin-cushion magnetic field 11 and the barrel magnetic field 12 lands on a fluorescent film 200 of a panel (not shown), the spot of the electron beam is distorted by the Lorentz effect and is lengthened in the diagonal direction of the picture at the edge of the fluorescent film 200, as shown in FIG. 2.

To solve this problem, a conventional method distorts the section of the electron beam emitted from the electron gun in the reverse direction of the nonuniform magnetic direction of the deflection yoke and differentiates the length of the focus of the electron beam scanning the center of the fluorescent film 200 from the focus of the electron beam scanning the edge of the fluorescent film 200.

This method distorts the cross-section of the electron beam which passes through the electronic lens (not shown) located between the electrodes of the electron gun in the reverse direction of the distortion by the deflection yoke, by making particular electronic lens have focusing and the emitting powers which respectively operate in vertical and horizontal directions. However, the electronic lens for thus distoring the electron beam complicates the manufacture of the electron gun since the the form of the passing hole of the electron beam in the electrodes of the electron gun must be changed. Therefore, there are limitations in changing the cross-section of the electron beam using the difference between the focusing power and the emitting power of the electronic lens.

SUMMARY OF THE INVENTION

It is an object of the present invention to provide a cathode ray tube designed to prevent the distortion of the spot of the electron beam scanned at the edge of a fluorescent film, by correcting the distortion of the section of the electron beam emitted from an electron gun.

It is another object of the present invention to provide a cathode ray tube designed to improve resolution by preventing the lengthening of shape of the section of the electron beam which is lands at the edge of the fluorescent film.

To achieve the objects, there is provided a cathode ray tube comprising an electron gun for emitting an electron beam, a deflection yoke which deflects the emitted electron beam, and correcting means including electromagnets disposed about a separator of the deflection yoke for correcting the shape of the cross-section of the emitted electron beam.

According to another aspect of the present invention, there is provided a cathode ray tube comprising an electron gun for emitting an electron beam, a cone portion on which is installed a deflection yoke which deflects the emitted electron beam, and correcting means including electromagnets disposed about the cone portion for correcting the cross-section of the emitted electron beam.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 3A:
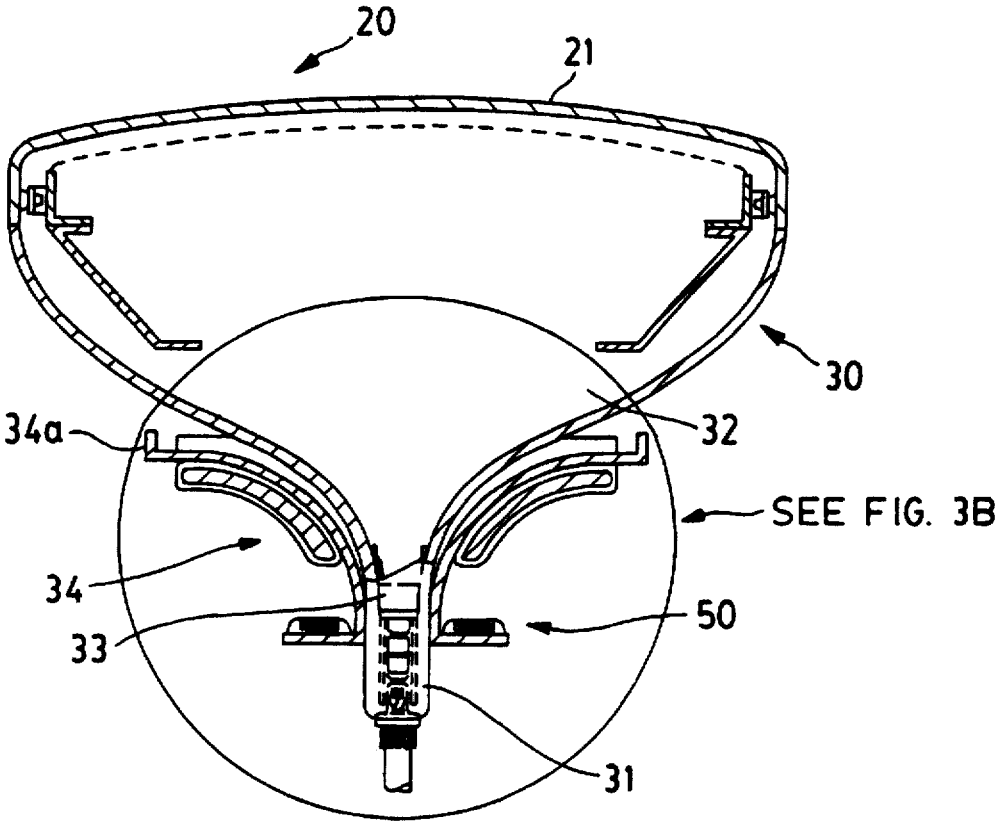
FIG. 3A and 3B are a cross-sectional view and an enlarged side view, respectively, of part of a cathode ray tube according to the present invention.
Figure 3B:
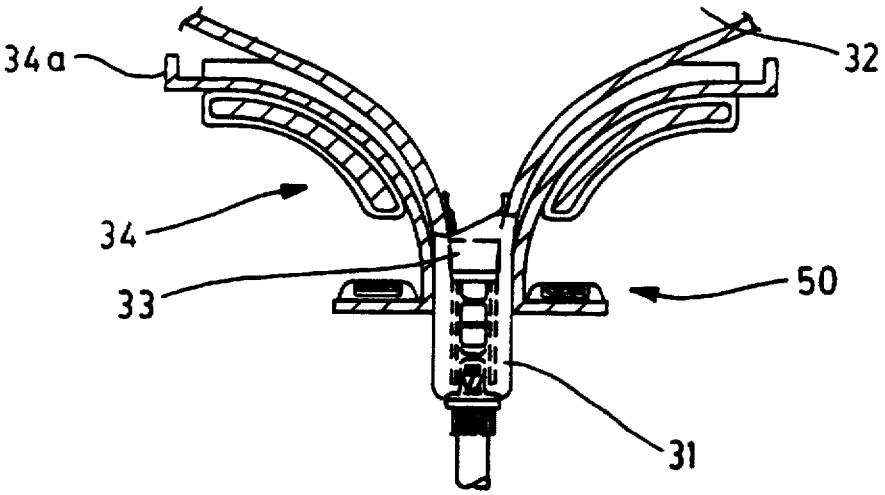

An embodiment of a cathode ray tube according to the present invention is shown in FIGS. 3A and 3B.

The cathode ray tube includes of a panel 20 inside which a fluoresent film 21 is located, a neck portion 31 which is coupled with the panel 20 and contains an electron gun 33 and on which is mounted a deflection yoke 34. A funnel 30 having a cone portion 32 is also provided. The deflection yoke 34 has a corrector 50. The corrector 50 is bonded with the deflection yoke 34 and compensates the cross-section of the electron beam emitted from the electron gun 33. The corrector 50 may be fixed to the neck portion 31 of the cathode ray tube by bonding or a separate fixing member (not shown).

Figure 4:
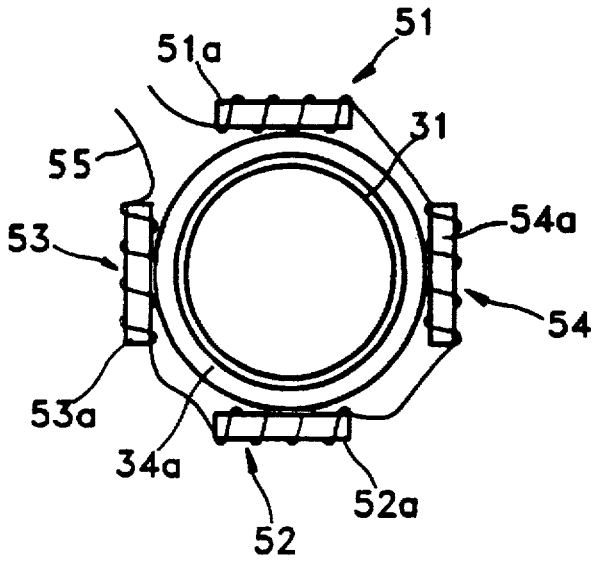
FIG. 4 shows an example of a corrector of the cathode ray tube according to the present invention.
Figure 5:
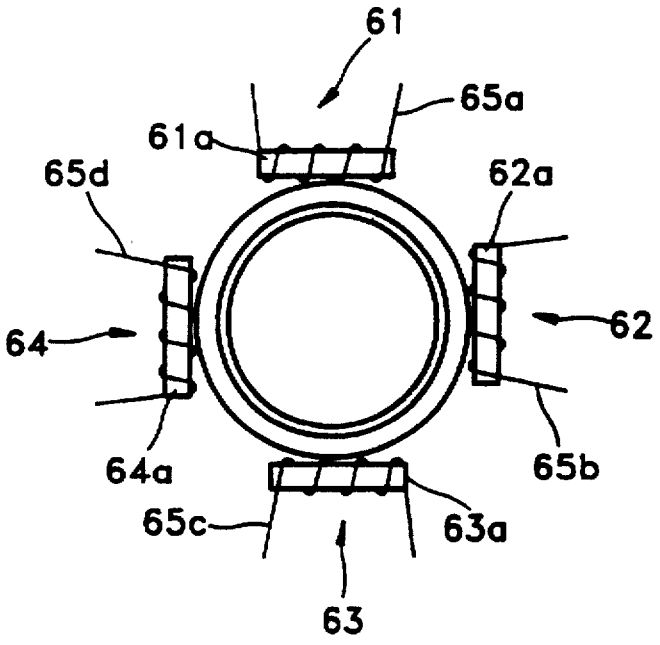
FIG. 5 shows another example of a corrector of the cathode ray tube according to the present invention.

A corrector according to the present invention is shown in FIG. 4. Referring to the drawing, the corrector includes electromagnets 51, 52, 53 and 54 respectively installed positioned about the circumference of the separator 34*a* of the deflection yoke. More particularly, the respective electromagnets 51, 52, 53 and 54 include iron members 51*a*, 52*a*, 53*a* and 54*a*, respectively and a coil 55 continuously wound on the pieces of iron. In a preferred embodiment, iron members 51*a*, 52*a*, 53*a*, and 54*a* are positioned about the neck portion at 90°, 0°, −90°, and 180°, respectively. Also, as shown in FIG. 5, electromagnets 61, 62, 63 and 64 can include pieces of iron 61*a*, 62*a*, 63*a* and 64*a* and coils 65*a*, 65*b*, 65*c* and 65*d* independently wound on the respective pieces of iron. The electromagnets 51, 52, 53 and 54 of FIG. 4 can be installed spaced from each other by a predetermined angle around the circumference of the separator 34*a*, the cone portion 32 of FIG. 3 or the neck portion 31 of FIG. 3 as necessary.

The voltage applied to the coil 55 is preferably applied synchronously with the deflection signal of the deflection yoke.

Figure 1:
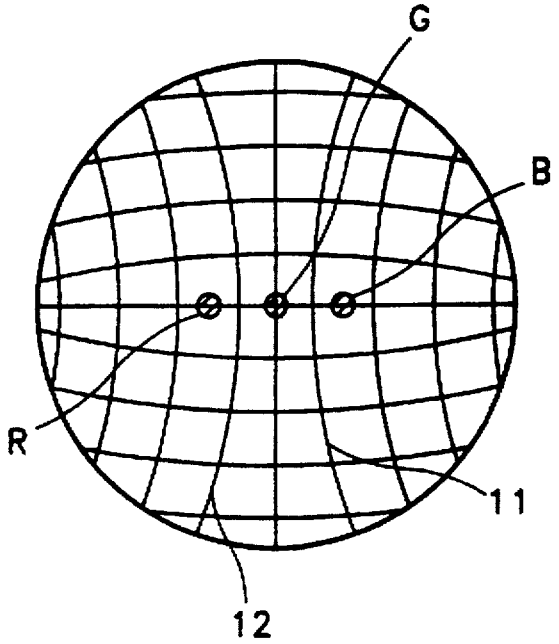
FIG. 1 PRIOR ART
FIG. 1 shows a magnetic field which is formed by the vertical and the horizontal deflection coils of a general deflection yoke.
Figure 2:
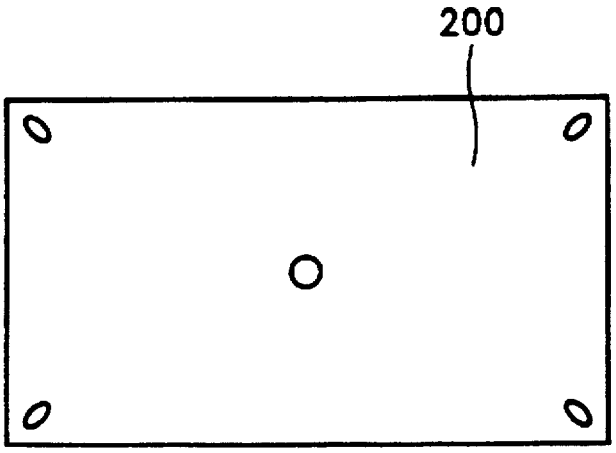
FIG. 2 PRIOR ART
FIG. 2 shows the section of the electronic beam landing at the edge of the fluorescent film after being deflected by a deflection yoke, in a conventional cathode ray tube.
Figure 6:
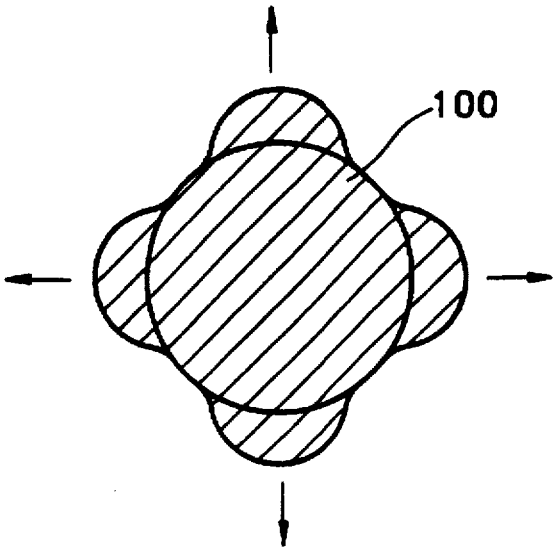
FIG. 6 is a sectional view showing the section of the electronic beam which is corrected by the corrector of the cathode ray tube according to the present invention.
Figure 7:
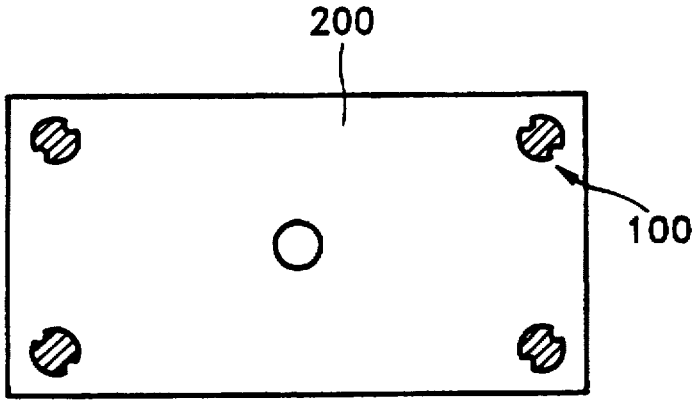
FIG. 7 shows the state in which the electronic beam corrected by the corrector of the cathode ray tube according to the present invention lands on the fluorescent film.

In the operation of the cathode ray tube according to the present invention, if the electron beam emitted from the electron gun 33 of FIG. 3 is deflected by the deflection yoke 34 and is scanning the edge of the fluorescent film 200 of FIG. 2, a voltage which is synchronized with the deflection signal is applied to the coil 55 (FIG. 4) of the corrector 50 (FIG. 3). With voltage thus-applied to the coil 55, a magnetic field is formed around the respective iron members 51*a*, 52*a*, 53*a* and 54*a*. The cross-section 100 of the electron beam emitted from the electron gun 33 is lengthened vertically and horizontally by the effect of the magnetic field as shown in FIG. 6, since an outward force is imposed on the electron beam at locations corresponding to the position of iron members 51*a*, 52*a*, 53*a*, and 54*a*. Therefore, as shown in FIG. 7, the cross-section of the electron beam is not lengthened diagonally by correction of the distortion of the cross-section of the electron beam scanning the edge of the fluorescent film 200 in the diagonal directions.

The respective electromagnets 51, 52, 53 and 54 of the corrector 50 can independently correct the distortion of the cross-section of the electronic beam.

As described above, the cathode ray tube according to the present invention improves the resolution of the picture at the edge of the fluorescent film. Also, distortion of the cross-section of the electron beam that lands on the fluorescent film, which is due to the nonuniform magnetic field and which occurs when the electron beam emitted from the electron gun is deflected by the deflection yoke and scans the fluorescent film, is prevented.

The present invention is not restricted to the above embodiment, and it is clearly understood that many variations within the scope and spirit of the present invention can be made by anyone skilled in the art.

What is claimed is:

1. A cathode ray tube comprising:

an electron gun for emitting an electron beam;

a deflection yoke for deflecting the electron beam emitted by said electron gun; and a plurality of electromagnets comprising discrete iron members respectively disposed about a periphery of a separator of said deflection yoke at a 90° position, 0° position, and −90° position, and a 180° position, and a single, continuous coil wound around all of the iron members, serially, for correcting the shape of a cross-section of the electron beam emitted from said electron gun.

2. The cathode ray tube as claimed in claim 1, wherein a voltage applied to said electromagnets is synchronized with a deflection signal applied to said deflection yoke.

3. A cathode ray tube comprising:

an electron gun for emitting an electron beam;

a deflection yoke for deflecting the electron beam emitted by said electron gun, said deflection yoke including a cone portion; and a plurality of electromagnets comprising discrete iron members respectively disposed about a periphery of the cone portion of said deflection yoke at a 90° position, 0° position, and −90° position, and a 180° position, and a single, continuous coil wound around all of the iron members, serially, for correcting a cross-section of the electron beam emitted from said electron gun.

4. The cathode ray tube as claimed in claim 3, further comprising means for applying voltage to said plurality of electromagnets, the voltage being synchronized with a deflection signal applied to said deflection yoke.

* * * * *